US006340335B1

(12) United States Patent
Recknagel

(10) Patent No.: US 6,340,335 B1
(45) Date of Patent: Jan. 22, 2002

(54) BOWLING LANE BALL RETURN CAPPING

(75) Inventor: Troy A. Recknagel, Muskegon, MI (US)

(73) Assignee: Brunswick Bowling & Billiards Corporation, Muskegon, MI (US)

( * ) Notice: Subject to any disclaimer, the term of this patent is extended or adjusted under 35 U.S.C. 154(b) by 0 days.

(21) Appl. No.: 09/501,929

(22) Filed: Feb. 10, 2000

Related U.S. Application Data

(63) Continuation of application No. 09/004,184, filed on Jan. 8, 1998, now Pat. No. 6,106,404.

(51) Int. Cl.[7] ..... A63D 1/08; B66C 23/06

(52) U.S. Cl. ..... 473/54; 473/113

(58) Field of Search ..... 473/54, 113, 115; 52/716.1, 718.01, 718.04, 718.05, 718.06, 718.07, 718.02, 718.03, 717.03; 428/100

(56) References Cited

U.S. PATENT DOCUMENTS

| | | | |
|---|---|---|---|
| 2,134,393 | A | 10/1938 | Bennett |
| 2,241,783 | A | 5/1941 | Kennedy |
| 2,949,303 | A | 8/1960 | Sherman |
| 3,279,795 | A | 10/1966 | Larson |
| 4,196,552 | A | 4/1980 | Bartlett |
| 4,801,143 | A | 1/1989 | Heddon |
| D301,909 | S | 6/1989 | Heddon |
| 4,913,433 | A | 4/1990 | Rochefort |
| 4,946,727 | A | 8/1990 | Kessler |
| 5,222,343 | A | 6/1993 | Anderson |
| 5,242,734 | A | 9/1993 | Rubin |
| 5,353,571 | A | 10/1994 | Berdan et al. |
| 5,626,524 | A | 5/1997 | Murrey |

*Primary Examiner*—William M. Pierce
(74) *Attorney, Agent, or Firm*—Price, Heneveld, Cooper, DeWitt & Litton

(57) ABSTRACT

A pair of spaced uprights defining a ball return channel therebetween, a pair of gutters astraddle the uprights, each gutter having an outer edge portion on the adjacent uprights, a plurality of anchor plates extending over said ball return channel and interfitted with the gutter outer edge portions, the plates and gutter outer edge portions being secured to the uprights, a dress cover extending over the ball return channel and anchor plates, removably interconnected to the anchor plates, a pair of upwardly extending, laterally spaced, parallel anchor protrusions proximate the anchor plate edge portions and having oppositely oriented lateral detents, the dress cover having a width greater than the lateral spacing of the protrusions, a pair of parallel, laterally spaced fastener legs depending from the dress cover, and having lateral detents generally aligned with the protrusion detents, at least one of 1) the pair of protrusions and 2) the pairs of legs, being resiliently shiftable to enable locking interengagement of the legs and protrusions to removably secure the dress cover on the anchor plates.

11 Claims, 2 Drawing Sheets

BOWLING LANE BALL RETURN CAPPING

CROSS-REFERENCE TO RELATED APPLICATION

This application is a continuation of U.S. patent application Ser. No. 09/004,184, entitled BOWLING LANE BALL RETURN CAPPING, filed on Jan. 8, 1998 now U.S. Pat. No. 6,106,404. Priority under 35 U.S.C. §120 is hereby claimed on the above-identified patent application. The entire disclosure of the above application is incorporated herein by reference.

BACKGROUND OF THE INVENTION

This invention relates to a cover assembly for a bowling lane ball return channel, and to the combination of the cover assembly with adjacent gutters.

Bowling balls returning to the front end of the lanes are purposely out of sight to prevent visual disruption of the game and for other reasons. The ball return track is thus covered with a housing and cover of some sort. However, there are times when access to the ball return track becomes necessary, e.g., for maintenance or to retrieve an errant ball that for some reason does not return completely and thus causes a blockade for subsequent balls, or other reasons. Access should not be so easy as to allow unauthorized persons to enter the ball return track, but should be readily accomplished by authorized and knowledgeable personnel. Further, the cover should be visually attractive since the large number of such covers and their considerable length makes them a substantial portion of the visual panorama of the bowling establishment.

Adjacent the ball return channel and astraddle thereof is a pair of gutters that serve adjacent bowling lanes. As is known, these gutters receive errant balls that depart the lane during bowling. Typically, these gutters are constructed separate from the ball return channel structure.

SUMMARY OF THE INVENTION

An object of this invention is to provide a unique bowling ball return channel cover assembly that enables ready access to the underlying ball return track by authorized and knowledgeable personnel, and that is pleasingly attractive. The assembly is composed of 1) a plurality of ball return anchor plates, preferably polymeric, of a width greater than the ball return channel, with upwardly extending, laterally spaced parallel anchor protrusions, and gutter locking lateral edges, and 2) a dress cover having a pair of depending fastener legs interlockable with the noted anchor protrusions, side walls that encompass the underlying plates, and contrasting color stripes for decorative purposes.

Another object is to provide a combination of ball return channel cover anchor plates and gutters wherein these are interconnected in a fashion enabling the securement of the gutter edge by the anchor plates when fastened to the return channel walls. The outer gutter edge interfits with the anchor plates by a rib and groove arrangement. Thus, the anchor plates serve at least a dual function.

Another object is to provide gutters which are assembled in segments interconnected end to end by sliding connectors.

These and other features, advantages, and objects of the present invention will be further understood and appreciated by those skilled in the art by reference to the following specification, claims, and appended drawings.

DETAILED DESCRIPTION OF PREFERRED EMBODIMENTS

Figures 1, 2, 2A:
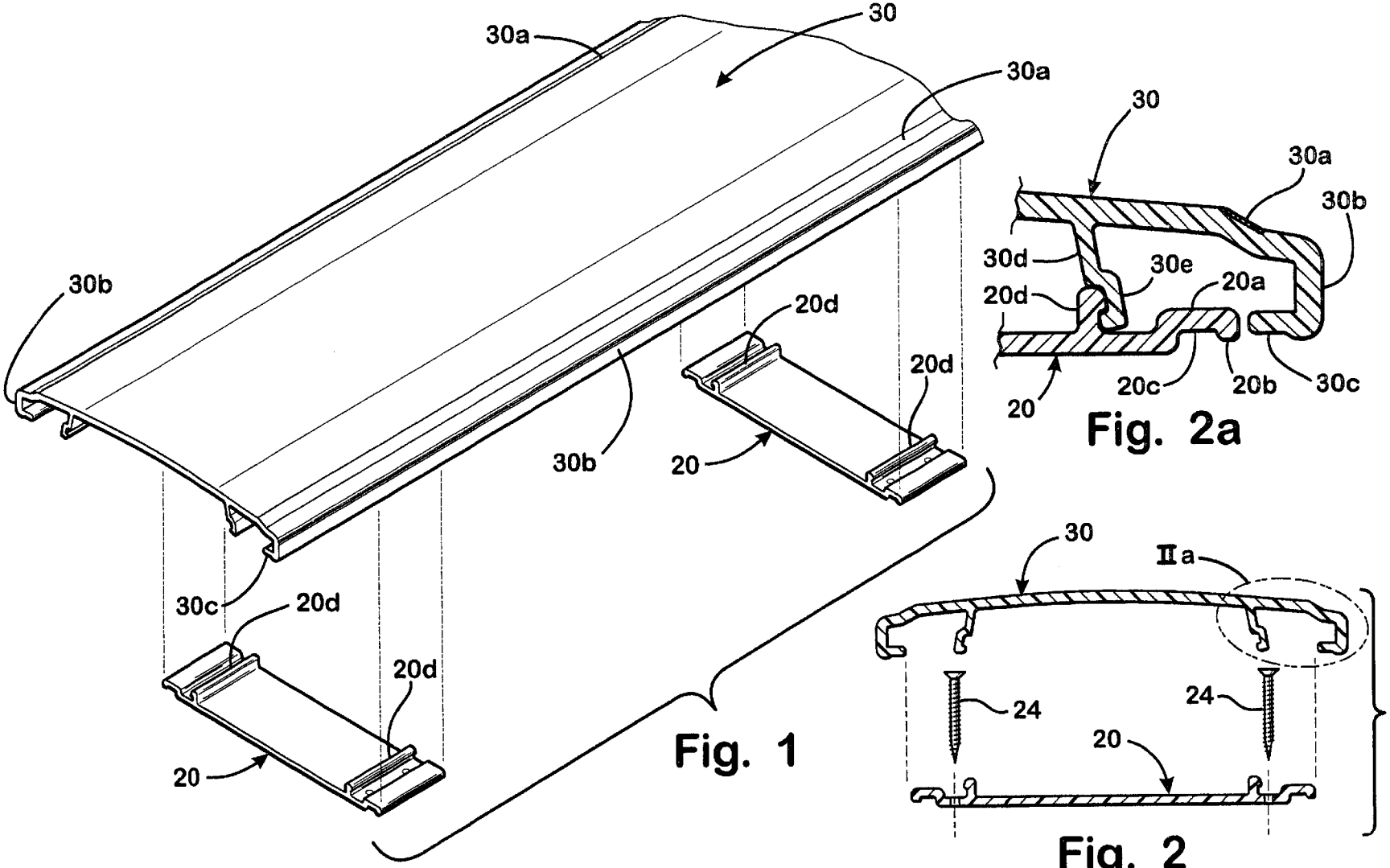
FIG. 1 is a perspective view of a pair of ball return anchor plates and a fragmentary portion of the dress cover.
FIG. 2 is a sectional elevational view of the components in FIG. 1.
FIG. 2A is an enlarged sectional elevational view of the dress cover connected to an anchor plate.
Figures 3, 4:
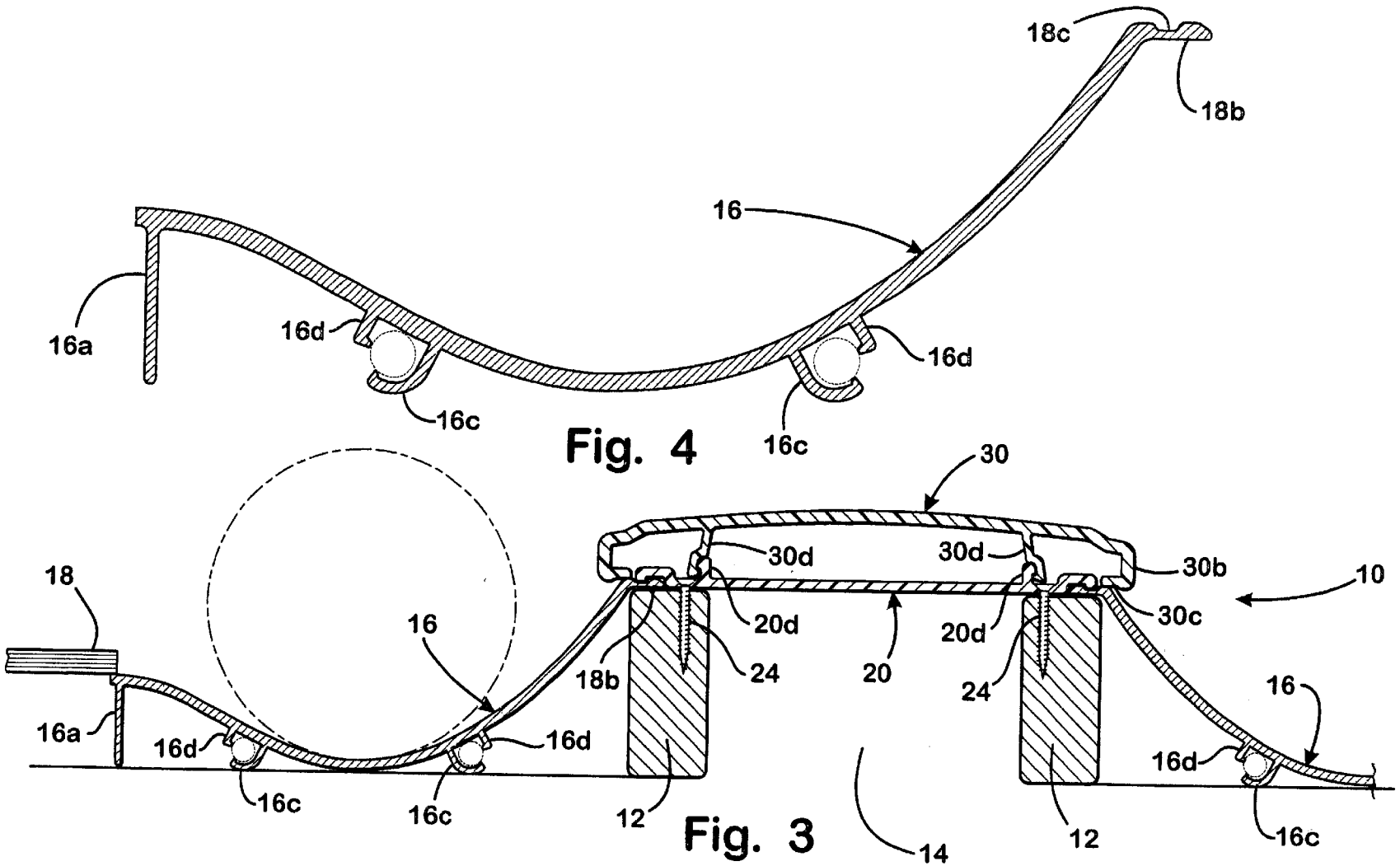
FIG. 3 is a sectional elevational fragmentary view of interlocked components of a ball return channel, and a pair of gutters straddling the ball return channel.
FIG. 4 is a sectional elevational view of one of the gutter elements.

Referring now specifically to the drawings, the assembly 10 (FIG. 3) depicted includes a pair of upright, elongated, laterally spaced ball return channel side walls 12 of wood, polymer or the equivalent, defining a ball return channel 14 therebetween. A ball return track (not shown) is mounted at the bottom of channel 14 for return of the bowling balls back to the head of the lane, i.e., to the bowlers. Straddling this ball return subassembly is a pair of mirror image gutters 16, each of which extends laterally from a bowling lane 18 to one of the walls or uprights 12. Each gutter has a structure formed with a vertical leg 16*a* integrally depending downwardly from the inner lateral edge portion adjacent lane 18, and an outer edge, horizontal support flange 18*b* engaging on the upper surface of upright 12. The center of the gutter is positioned to preferably engage an underlying surface. The bottom surface of the gutter is convex and the upper surface is concave so as to receive any bowling balls which roll off the lane. The gutter is preferably formed of polymer such as extruded segments to be joined end to end. Thus, the underside of gutter segment 16, laterally astraddle the center thereof, has a pair of receiving pockets preferably longitudinally oriented to receive the ends of tube connectors shown in dotted lines in FIG. 3. Each connector pocket preferably includes a longer bottom leg 16*c* and a shorter upper leg 16*d*, both integral with the gutter segment and resiliently flexible. These form a discontinuous loop pocket. Slidable insertion of a tube end forces these two legs apart a slight amount against the inherent resilient bias thereof to secure the tubes in place and allow connection of segments of gutters together along the length of the lane. Hence, the gutters can be readily assembled at the bowling center. Preferably, the gutter is made of a polymer such as PVC, a polyester, or other suitable polymer.

The gutter flange 18*b* resting on upright 12 is shown to include an elongated concavity 18*c* in its upper surface to receive a protrusion, specifically an edge rib of the anchor plates, as will be explained.

Mounted at intervals along the length of the ball return channel is the plurality of support and anchor bracket plates 20, each of which extends laterally across the ball return channel 14 to have ends which are secured to the two spaced uprights 12. Specifically, these ends are secured to uprights 12 as by threaded fasteners 24 which extend through suitable orifices in plates 20 and are embedded into the side wall uprights 12. The opposite lateral ends of each plate 20 is shown to include an upwardly offset portion 20*a* and a downwardly protruding edge rib 20*b* therefrom to anchor the gutters in place. Rib 20*b* interfits with groove 18*c* formed in flange 18*b* of the gutter element, while the underside groove

20*c* formed by offset 20*a* receives the outermost edge portion of the gutter flange 18*b*. Anchor plates 20 have a pair of integral, upwardly extending connector protrusions 20*d* with laterally offset detents. These plates thus serve multiple purposes of stabilizing the upright elements 12 for the ball return channel, anchoring the edges of gutter segments 16, and securing the ball return channel cover 30 as will be described.

Cover 30 is an elongated element preferably formed of extruded polymer, e.g., polyvinylchloride, polyester, or the like, and preferably formed in segments of convenient length. The cover has a decorative surface which preferably incorporates a pair of elongated stripes 30*a* at downwardly outwardly sloped wall portions adjacent the outer edges of the cover. These contrasting stripes can be co-extruded with the cover or subsequently applied. This cover preferably includes a pair of downwardly depending outer side walls 30*b* integral with the cover top surface, and optional inwardly projecting lower flanges 30*c* from side walls 30*b* which may rest on the top surfaces of the gutter flanges. Protruding downwardly from the underside of cover 30 is a pair of integral, laterally deflectable, resilient connector legs 30*d* which are generally: aligned with the integral upwardly extending connector protrusions 20*d* of brackets 20. Legs 30*d* have laterally offset detents 30*e* here shown to form inwardly facing grooves, while protrusions 20*d* have opposite laterally offset detents which are oriented to engage detents 30*e* of legs 30*d*. Cover segments 30 can be intermitted with plates 20 as by pressing down on the cover to bias legs 30*d* into a momentary deflected condition for a snap-on fit, or by sliding the cover lengthwise to cause the detents to interengage. Similarly, the cover segments can be removed by forcing them upwardly or sliding them longitudinally, for access to ball channel 14 for maintenance or other reasons.

Assembly of all the components of the combination can be readily achieved. Specifically, the two mirror image gutters 16, if formed of segments, can be assembled. The segments of gutter 16 are longitudinally secured together by inserting connector tubes or the like as depicted in phantom in FIG. 4 to secure the longitudinal ends of the gutter together. With insertion of the connectors, legs 16*c* and 16*d* are shifted slightly against their inherent bias to achieve a tight fit. The gutters are placed with inner leg 16*a* supporting the gutter adjacent lane 18, and the opposite edge flange 18*b* rested upon one of uprights 12. Next, a plurality of anchor plates 20 are interengaged with the edges of the two gutters and fastened to uprights 12 by threaded fasteners 24 such as screws, this action also locking the gutter elements in place. Next, dress cover 30 is connected over ball channel 14 to anchor plates 20 either by positioning segments vertically on the plates and pressing the cover segment down to deflect legs 30*d* laterally for engagement of the detents of the legs with the detents of protrusions 20*d*, or alternatively by sliding cover 30 longitudinally into engagement with successive anchor plates 20. The decorative cover can have contrasting colors, e.g., on the stripes 30*a*, or the stripes can be reflective in nature.

Cover segments can be removed quickly by disengaging the detents or by sliding the cover longitudinally for access to the ball return channel.

The above description is considered that of the preferred embodiments only. Modifications of the invention will occur to those skilled in the art and to those who make or use the invention. Therefore, it is understood that the embodiments shown in the drawings and described above are merely for illustrative purposes and not intended to limit the scope of the invention, which is defined by the following claims as interpreted according to the principles of patent law, including the doctrine of equivalents.

The invention claimed is:

1. A bowling lane gutter comprising:

an elongated gutter of interconnected polymeric segments, said segments each having an underside having thereon a pair of pockets aligned with like pockets on adjacent segments, said pockets each comprising a loop, said pockets each being formed of a pair of legs which are resiliently biased toward each other such that there are four legs on the underside of the segment; and connector elements between said segments, anchored in said pockets of adjacent gutter segments to form the gutter.

2. The bowling lane gutter of claim 1, wherein said segments are made of extruded polymer and said pockets are integral threrewith.

3. The bowling lane gutter of claim 1, wherein said pockets each comprise a discontinuous loop.

4. The bowling lane gutter of claim 1, wherein said legs extend downward from a bottom surface of segments.

5. The bowling lane gutter of claim 1, wherein said loops providing longitudinally aligned openings for receiving said connector elements.

6. A bowling lane gutter comprising:

an elongated gutter of interconnected polymeric segments, said segments each having at least one pocket aligned with a like pocket on an adjacent segment, said pocket comprising a loop, said loop being formed between a pair of legs which extend downward from said segments; and connector elements between said segments, anchored in said pockets of adjacent gutter segments to form the gutter, wherein each said connector element is a cylindrical rod.

7. A bowling lane gutter comprising:

an elongated gutter of interconnected polymeric segments, said segments each having at least one pocket aligned with a like pocket on an adjacent segment, said pocket comprising a loop; and a cylindrical connector rod extending between at least two of said segments, anchored in said pockets of adjacent gutter segments to form the gutter.

8. The bowling lane gutter of claim 7, wherein said pockets each comprise a discontinuous loop.

9. The bowling lane gutter of claim 7, wherein said loop includes a pair of legs extending downward from a bottom surface of segments.

10. The bowling lane gutter of claim 7, wherein said loop provides longitudinally aligned openings for receiving said connector rod.

11. The bowling lane gutter of claims 7, wherein said loop provides a substantially circular opening.

* * * * *